US010590784B2

(12) United States Patent
Kang

(10) Patent No.: US 10,590,784 B2
(45) Date of Patent: Mar. 17, 2020

(54) NOZZLE BOX ASSEMBLY

(71) Applicant: DOOSAN HEAVY INDUSTRIES & CONSTRUCTION CO., LTD., Gyeongsangnam-do (KR)

(72) Inventor: Dongwoo Kang, Gyeonggi-do (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 324 days.

(21) Appl. No.: 15/424,760

(22) Filed: Feb. 3, 2017

(65) Prior Publication Data

US 2017/0234149 A1 Aug. 17, 2017

(30) Foreign Application Priority Data

Feb. 11, 2016 (KR) ..... 10-2016-0015692

(51) Int. Cl.
*F01D 9/04* (2006.01)
*F01D 25/24* (2006.01)
*F01D 11/00* (2006.01)

(52) U.S. Cl.
CPC ..... *F01D 9/047* (2013.01); *F01D 9/041* (2013.01); *F01D 11/005* (2013.01); (Continued)

(58) Field of Classification Search
CPC ..... F01D 9/047; F01D 9/041; F01D 5/146; F01D 9/042; F01D 9/044; F05D 2240/128
See application file for complete search history.

(56) References Cited

U.S. PATENT DOCUMENTS 2,654,566 A * 10/1953 Boyd ..... F01D 9/042 415/137
4,063,845 A * 12/1977 Allen ..... F01D 11/005 277/633

(Continued)

FOREIGN PATENT DOCUMENTS

EP 1777372 A2 4/2007
EP 2837770 A1 2/2015

(Continued)

OTHER PUBLICATIONS

Chung, KR 10-1022810, machine translation (Year: 2011).*

(Continued)

*Primary Examiner* — Hung Q Nguyen
*Assistant Examiner* — Mark L. Greene
(74) *Attorney, Agent, or Firm* — Invenstone Patent, LLC

(57) ABSTRACT

A nozzle box assembly includes steam inlets, through which working steam is supplied, a torus part connected to the steam inlets so as to form an annular steam path and having an opening portion, in which a part of the front surface of the annular steam path is opened, a bridge ring connected to the front surface of the torus part and having a bridge inside, and a steam path ring connected to the bridge ring so as to provide a path, which is connected to a stage, and provided with a plurality of vanes, wherein the bridge ring and the steam path ring are formed of the coupling of a plurality of divisions, which are divided in the circumferential direction thereof, and the divisions are coupled to the front surface of the torus part.

16 Claims, 11 Drawing Sheets

(52) U.S. Cl.
CPC ..... *F01D 25/246* (2013.01); *F05D 2220/31* (2013.01); *F05D 2230/70* (2013.01); *F05D 2230/72* (2013.01); *F05D 2240/128* (2013.01); *F05D 2240/55* (2013.01); *F05D 2260/36* (2013.01)

(56) References Cited

U.S. PATENT DOCUMENTS

| | | | | |
|---|---|---|---|---|
| 5,259,727 | A * | 11/1993 | Quinn | B23P 6/005 29/402.08 |
| 6,754,956 | B1 | 6/2004 | Tomko et al. | |
| 6,964,554 | B2 * | 11/2005 | Groenendaal | F01D 9/041 415/136 |
| 7,331,754 | B2 * | 2/2008 | O'Clair | F01D 9/04 415/1 |
| 7,954,323 | B2 * | 6/2011 | Bellows | F01D 5/288 411/378 |
| 2004/0107573 | A1 | 6/2004 | Tomko et al. | |
| 2014/0363281 | A1 | 12/2014 | Dorow et al. | |
| 2015/0030460 | A1 * | 1/2015 | Kottilingam | F01D 5/20 416/97 R |
| 2015/0050134 | A1 * | 2/2015 | Shurrock | F01D 9/02 415/191 |
| 2017/0204733 | A1 * | 7/2017 | Kang | F01D 9/041 |

FOREIGN PATENT DOCUMENTS

| | | | |
|---|---|---|---|
| JP | 58210303 | A | 12/1983 |
| JP | 61142303 | A | 6/1986 |
| JP | 05-179994 | A | 7/1993 |
| JP | 05-231102 | A | 9/1993 |
| JP | 08-014003 | A | 1/1996 |
| JP | 2007-113572 | A | 5/2007 |
| KR | 10-2008-0022523 | | 3/2008 |
| KR | 101022810 | B1 | 3/2011 |

OTHER PUBLICATIONS

Office Action issued by the Korean Intellectual Property Office dated Mar. 22, 2017 in connection with the Korean Application No. 10-2016-0015692, which corresponds to the above-referenced U.S. application.

An extended European Search Report issued by the European Patent Office dated Jun. 22, 2017 in connection with European Patent Application No. 16203008.4.

* cited by examiner

View A–A

Section B–B

NOZZLE BOX ASSEMBLY

CROSS-REFERENCE TO RELATED APPLICATION

The present application claims the benefit of Korean Patent Application No. 10-2016-0015692 filed in the Korean Intellectual Property Office on Feb. 11, 2016, the entire contents of which are incorporated herein by reference.

BACKGROUND

The present disclosure relates to a nozzle box assembly and, more particularly, to a nozzle box assembly provided to the stage inlet of a steam turbine so as to inject steam to the stage.

A nozzle box assembly for a steam turbine, as shown in FIG. 1 and FIG. 2, includes three constituent elements, that is, a torus 14, a bridge ring 16 and a steam path ring 12. Each of the constituent elements is prepared as a 180° segment in the initial stage and then the constituent elements are welded in sequence so as to form two nozzle box halves 18. FIG. 1 and FIG. 2 show one of the nozzle box halves 18, wherein the other one also has the same shape and structure.

Next, the two halves 18 are joined together along a horizontal center line so as to form a nozzle box assembly for a steam turbine. Each of the nozzle box halves 18 includes one or more steam inlets 10, which are integrally formed with the torus 14. The steam inlets 10 are connected to the torus 14 on a plane surface, which is perpendicular to the rotation shaft of the turbine.

During the operation of the steam turbine, steam from a steam supply source such as a boiler and the like is introduced through the steam inlets 10 and flows in the torus 14. The flow direction of the steam is typically changed to the axial direction such that the steam flows through the annular opening of the bridge ring 16 to the inside of the steam path ring 12. The steam path ring 12 is provided with a series of nozzles, including airfoil vanes 13 for directing the steam flow.

The nozzle box assembly as described above has the configuration, in which the torus 14, the bridge ring 16 and the steam path ring 12 are coupled together. More specifically, as for this coupling, the bridge ring 16 and the steam path ring 12 are respectively formed in advance and then the steam path ring 12 is welded to the bridge ring 16 after the bridge ring 16 is welded to the torus 14, thereby achieving the mutual welding.

The coupling method as above employs a method for forming each of the bridge ring 16 and the steam path ring 12 integrally or in a semicircular body. In this case, if partially defective bridge rings 16 or vanes 13 are generated in the process of manufacture, the whole product has to be abandoned. Therefore, the coupling method is inefficient in terms of manufacture and excessive labor is required for the welding.

Further, if the bridge ring 16 or the vane 13 is partially damaged during the operation of the steam turbine, the welding coupling has to be released and then the whole bridge ring 16 or the steam path ring 12 has to be replaced, resulting in the difficulty of maintenance.

BRIEF SUMMARY

Accordingly, the present disclosure has been made to address the above-mentioned problems, and it is an objective of the present disclosure to provide a nozzle box assembly, in which the efficiency of manufacturing procedure is improved and, when a part is damaged, it is possible to simply replace the corresponding part.

To accomplish the above objective, according to the present disclosure, there is provided a nozzle box assembly, including: steam inlets, through which working steam is supplied; a torus part connected to the steam inlets so as to form an annular steam path and having an opening portion, in which a part of the front surface of the annular steam path is opened; a bridge ring connected to the front surface of the torus part and having a bridge inside; and a steam path ring connected to the bridge ring so as to provide a path, which is connected to a stage, and provided with a plurality of vanes, wherein the steam path ring is formed of the coupling of a plurality of divisions arranged along the circumferential direction thereof and the divisions are coupled to the front surface of the torus part.

In addition, each of the divisions may include at least one or more bridges and vanes.

Meanwhile, the division may include a protrusion coupling part, which is protruded in the backward direction, and the front surface of the torus part may include a depression coupling part, to which the protrusion part is coupled.

Further, the protrusion coupling part and the depression coupling part may respectively have a coupling section in a dovetail shape, and the protrusion coupling part may be fitted into the depression coupling part along the circumferential direction.

Besides, the dovetail shape may include at least one or more wrinkled side portions.

In addition, the divisions, which are connected to neighboring divisions, respectively include a protrusion sealing part formed on one of side surface portions thereof and a depression sealing part formed on the other one side surface portion, such that the protrusion sealing parts and the depression sealing parts of the neighboring divisions are connected to each other through mutual engagement so as to carry out sealing of the side surface portions.

Meanwhile, the nozzle box assembly may further include an annular sealing plate provided to be fitted into annular sealing grooves, which are formed on top of joint surfaces of the divisions and the torus part, which are coupled to each other.

Besides, the nozzle box assembly may further include an elastic sealing member disposed between the bottom surface of the sealing plate and the bottom surface of the sealing groove.

Further, a flange part may be respectively provided to the rear surface edges of the divisions and the front surface edge of the torus part such that the divisions are coupled to the torus part by the coupling of the flanges.

In addition, the nozzle box assembly may further include a restraining ring for surrounding the edges of the divisions.

The nozzle box assembly according to the present disclosure described as above is formed by coupling the divisions provided to the steam path ring and the bridge ring, thereby increasing the manufacturing efficiency.

Further, it is possible to achieve stable coupling of the torus part through the engagement of the protrusion coupling part and the depression coupling part, thereby replacing the welding.

Meanwhile, it is also possible to achieve stable coupling of the torus part by providing the flange parts, thereby replacing the welding.

In addition, even though the divisions are employed, the leakage of combustion gas can be reduced or minimized between the divisions by the protrusion sealing part and the depression sealing part. Also, the leakage of the combustion gas may be minimized between the divisions and the torus part by providing the sealing plate and the elastic sealing member.

Besides, it is possible to reduce or prevent the decrease of structural strength, which may be possibly caused by the employing of the divisions, by providing the outer restraining ring and the inner restraining ring.

DETAILED DESCRIPTION

Hereinafter, with reference to the attached drawings, embodiments of the present disclosure will be described in detail. In connection with adding reference signs to the elements in each of the drawings, the same elements have the same reference signs as far as possible even though they are illustrated in different figures.

In addition, the terms such as first, second, A, B, a, b and the like can be used in explaining the elements of the example embodiments of the present disclosure. These terms are simply used to distinguish corresponding elements from other elements but not intended to limit the nature of the corresponding component elements by the terms. Additionally, it should be also understood that the expression that some component is "connected", "coupled" or "linked" to another component means that some component is directly connected to another component or is indirectly "connected", "coupled" or "linked" to another component through a further component interposed between each of the components.

Legend of References Numerals in Drawings

Figure 3A:
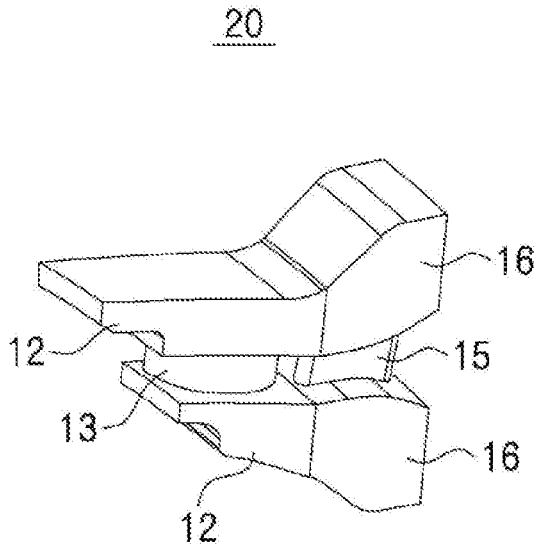
FIG. 3A is a perspective view of a division according to an embodiment of the present disclosure.
Figure 3B:
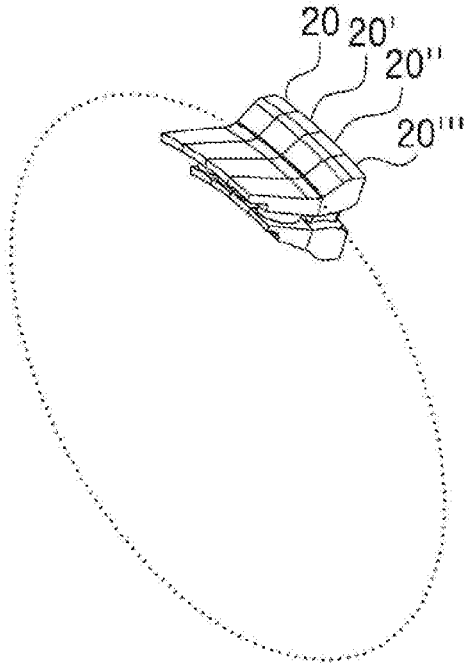
FIG. 3B is a perspective view of coupling of a plurality of divisions.

12: steam path ring
13: vanes
14: torus part
15: bridge
16: bridge ring
20: divisions
21: protrusion sealing part
22: recess
30: coupler
31, 32: protrusion coupling part
31', 32': recesses
33, 33': saw-tooth portion
35, 35': flange part
36: coupling screw
37: outer restraining ring
38: inner restraining ring
40: sealing plate
41: elastic sealing member FIG. 3 shows the structure of a division 20 according to the present disclosure.

A nozzle box assembly according to the present disclosure includes steam inlets, through which working steam is supplied, a torus part 14, which is connected to the steam inlets so as to form an annular steam path and has an opening portion, in which a part of the front surface of the annular steam path is opened.

The torus part 14 is connected to a bridge ring 16 and a steam path ring 12, wherein the bridge ring 16 is connected to the front surface of the torus part 14 and has a bridge 15 therein. Further, the steam path ring 12 is connected to the front surface of the bridge ring 16 so as to provide a path, which is connected to a stage, and has a plurality of vanes provided therein.

FIG. 3 shows the steam path ring 12 and the bridge ring 16, which are formed of the coupling of a plurality of divisions 20, in which FIG. 3(*a*) shows a single one of the divisions 20 and FIG. 3(*b*) shows that the plurality of divisions 20, which are connected to each other in the circumferential direction. Even though FIG. 3(*b*) shows that totally four divisions 20 are coupled as an example, a plurality of divisions 20 are further provided throughout the remaining section displayed by a circular dotted line such that the entire plurality of divisions 20 form a ring shape. That is, the bridge ring 16 and the steam path ring 12 are formed by coupling the plurality of divided divisions 20, which are connected to each other along the circumferential direction. Each of the divisions 20 is coupled to the front surface of the torus part 14.

Figure 1:
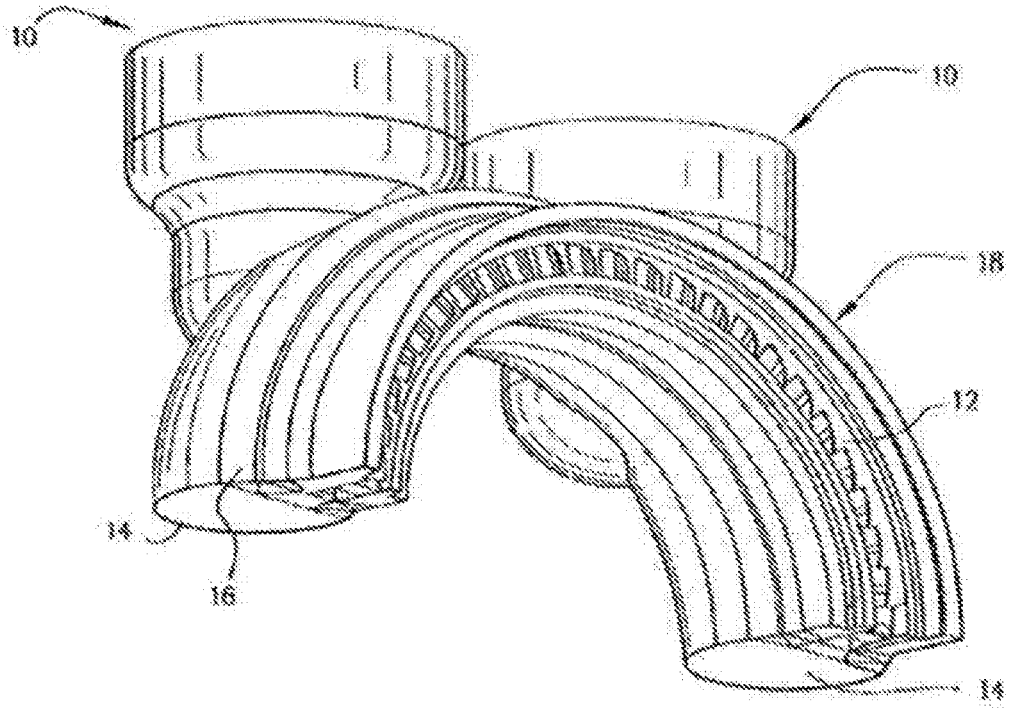
FIG. 1 Prior Art
FIG. 1 is a perspective view of a nozzle box assembly.
Figure 2:
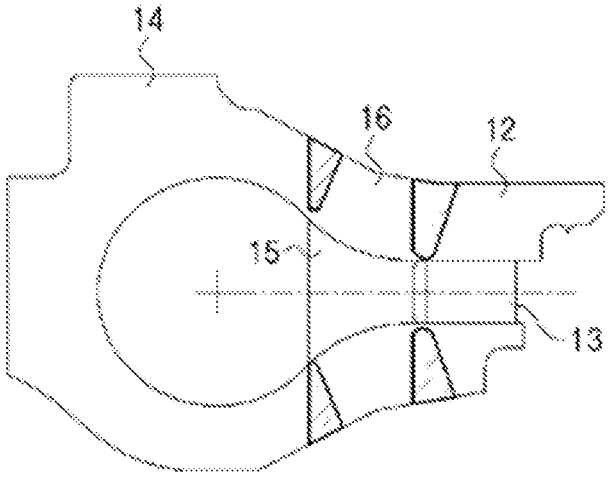
FIG. 2 Prior Art
FIG. 2 is a cross-sectional view of a nozzle box assembly.

As shown in FIG. 3(*a*), it is preferable that the division 20 includes at least one or more bridges 15 and at least one or more vanes 13. As mentioned hereinabove, as the divisions 20 are connected to each other into a shape of a ring, the bridges 15 and the vanes 13 are also arranged in an annular shape as shown in FIG. 1 and FIG. 2, wherein each of the bridges 15 and the vanes 13 serves as a support to connect the upper portions and the lower portions of the steam path ring 12 and the bridge ring 16. Therefore, it is preferable in terms of structural strength of the divisions 20 that the single division 20 includes at least one or more bridges 15 and at least one or more vanes 13.

Figure 4:
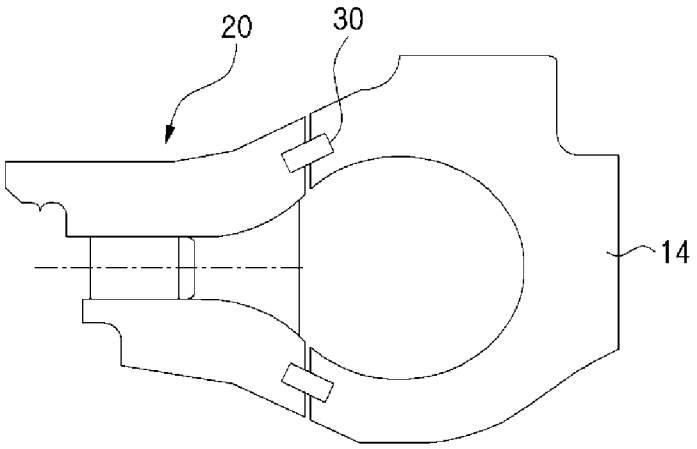
FIG. 4 is a diagram of a coupler according to an embodiment of the present disclosure.

Meanwhile, FIG. 4 is a conceptual diagram for showing the coupling between the divisions 20 and the torus part 14.

Referring to FIG. 4, the division 20 and the torus part 14 respectively have recessed portions at both sides thereof and couplers 30 are fitted between the recessed portions. It is also conceivable that the division 20 includes protrusion coupling parts 31, 32, which are protruded in the backward direction, and the torus part 14 includes recesses 31', 32', which are formed on the front surface of the torus part 14 so as to be coupled with the protrusion coupling parts 31, 32, as shown in FIG. 5 and FIG. 7.

Figure 7:
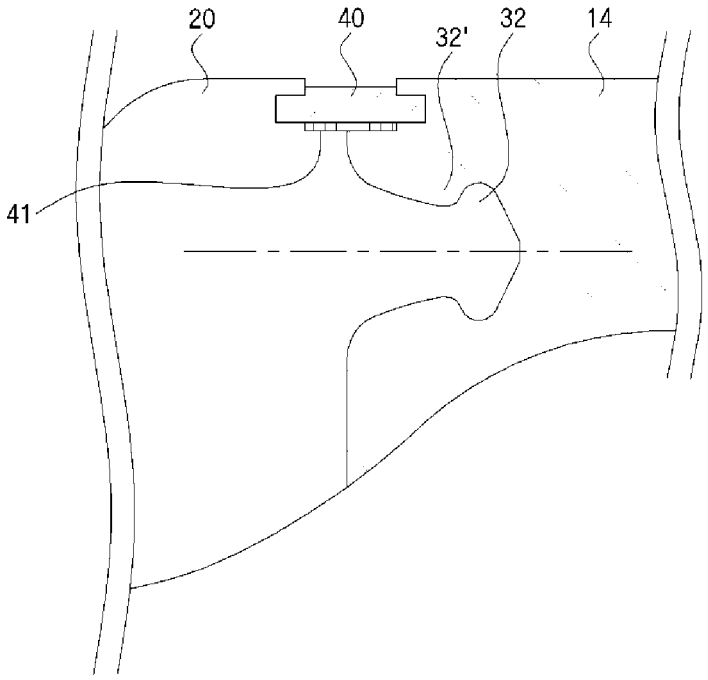
FIG. 7 is a diagram illustrating a protrusion coupling part and a depression coupling part according to an embodiment of the present disclosure.

Meanwhile, the protrusion coupling parts 31, 32 and the recesses 31', 32' respectively have a coupling section in a dovetail shape such that the protrusion coupling parts 31, 32 are fitted into the recesses 31', 32' along the circumferential direction, as shown in FIG. 7. If the division 20 and the torus part 14 are coupled in the shape of a dovetail, sliding movement in the circumferential direction and coupling can be achieved while movement in the normal direction of joint surfaces is limited, such that stable coupling is maintained.

Figure 5:
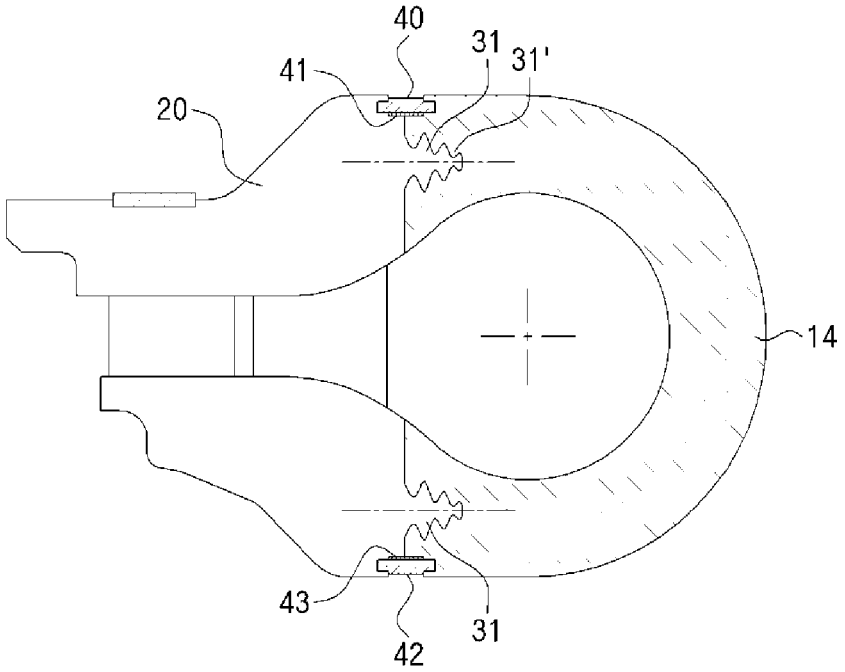
FIG. 5 is a diagram illustrating a protrusion coupling part and a depression coupling part according to an embodiment of the present disclosure.

Further, in order to increase the sealing effect and the strength of the joint surfaces, it is preferable that the dovetail shape includes at least one or more wrinkled side portions, as shown in FIG. 5.

Figure 12:
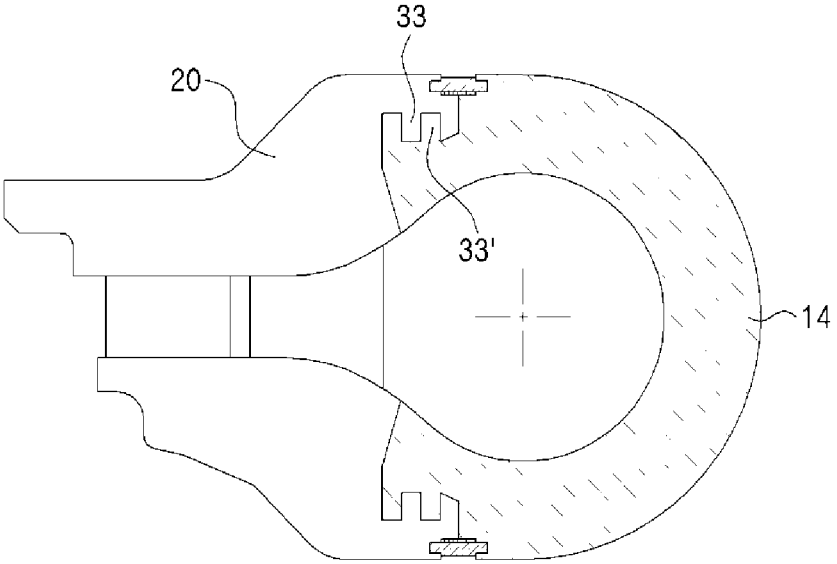
FIG. 12 is a diagram illustrating a coupler in the shape of a saw-tooth according to an embodiment of the present disclosure.

Meanwhile, the coupler 33, 33' in the shape of a saw-tooth 33, 33', as shown in FIG. 12. That is, a saw-tooth portion 33' formed on the front surface of the torus part 14 is engaged with the saw-tooth portion 33 formed on the rear surface of the division 20 through mutual male-and-female engagement.

Figure 6:
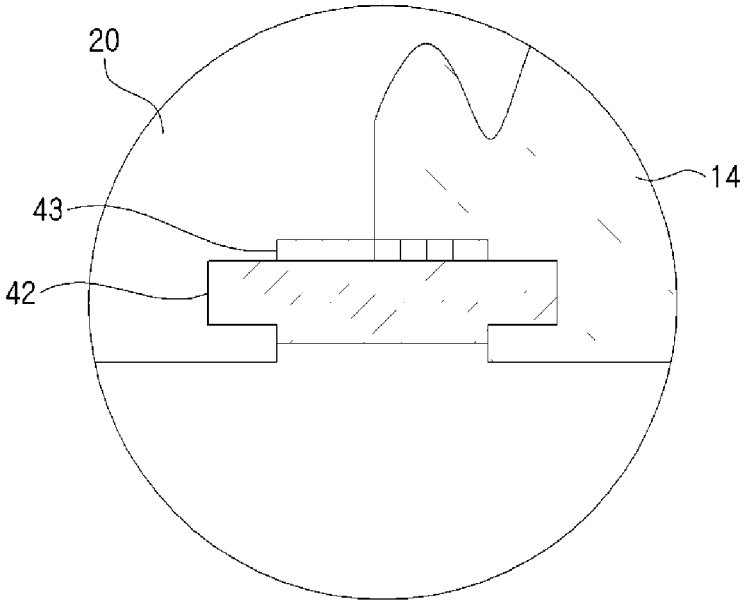
FIG. 6 is a diagram illustrating a sealing plate and an elastic sealing member according to an embodiment of the present disclosure.

Meanwhile, as shown in FIG. 5 and FIG. 6. annular sealing grooves may be provided to the top portions of the joint surfaces of the divisions 20 and the torus part 14, which are coupled with each other, and an annular sealing plate 40 is further provided so as to be fitted into the sealing grooves.

The sealing problem of the combustion gas of high temperature and high pressure, which may occur in such a structure, may be alleviated by coupling the divisions 20 and the torus part 14 with each other through the mutual fitting in a dovetail shape, which may avoid the need for welding.

The sealing plate 40 can carry out the sealing in a direct surface contact state with respect to the sealing grooves. Meanwhile, an elastic sealing member 41, for example, a rubber plate and the like, may be further provided between the bottom surface of the sealing plate 40 and the bottom surface of the sealing groove.

In addition to such a rubber plate, materials which have elastic force, between the bottom surface of the sealing plate 40 and the bottom surface of the sealing groove, as the elastic sealing member 41, may be used to increase the sealing performance.

Figure 8A:
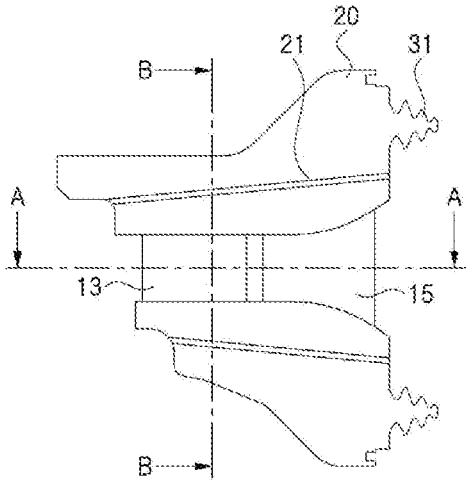
FIG. 8A is a diagram illustrating a protrusion sealing part and a depression sealing part according to an embodiment of the present disclosure.
Figure 8B:
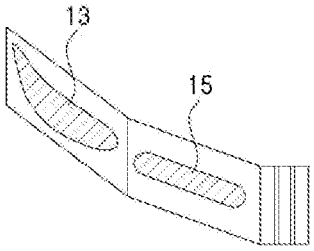
FIG. 8B is a cross sectional view taken along line A-A in FIG. 8A.
Figure 8C:
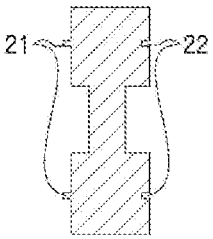
FIG. 8C is a cross sectional view taken along line B-B in FIG. 8C.
Figure 9:
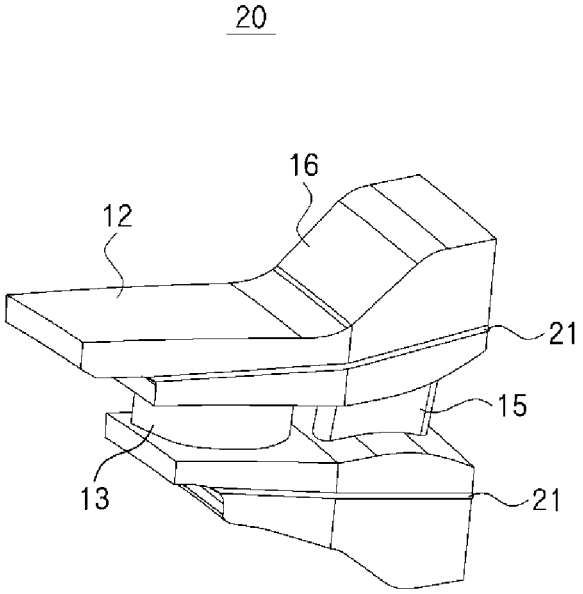
FIG. 9 is a perspective view illustrating a division, which employs the protrusion sealing part and the depression sealing part, according to the embodiment of the present disclosure.

Meanwhile, FIGS. 8 and FIG. 9 show a protrusion sealing part 21 and a recess 22, which are provided to the side surface of the division 20.

More specifically, the divisions 20, which are connected to neighboring divisions, respectively include the protrusion sealing part 21 formed on one of side surface portions thereof and the recess 22 formed on the other side surface portion. Therefore, the protrusion sealing parts 21 and the recess 22 of the neighboring divisions are engaged with each other so as to carry out the sealing of the side surface portions.

That is, if the protrusion sealing part 21 is provided to the right side surface of the individual division 20, the recess 22 is provided to the right side surface thereof. The right side surface of one division 20 is connected to the left side surface of a neighboring division 20 thereof, wherein the protrusion sealing part 21 is fitted in the recess 22.

The protrusion sealing part 21 and the recess 22, as mentioned above, carry out the function as a seal for preventing the high temperature and high pressure combustion gas inside the divisions 20 from leaking to the outside and, simultaneously, the function as a guide in the mutual coupling of the divisions 20 so as to restrain the mutual movement of the divisions 20.

Figure 10:
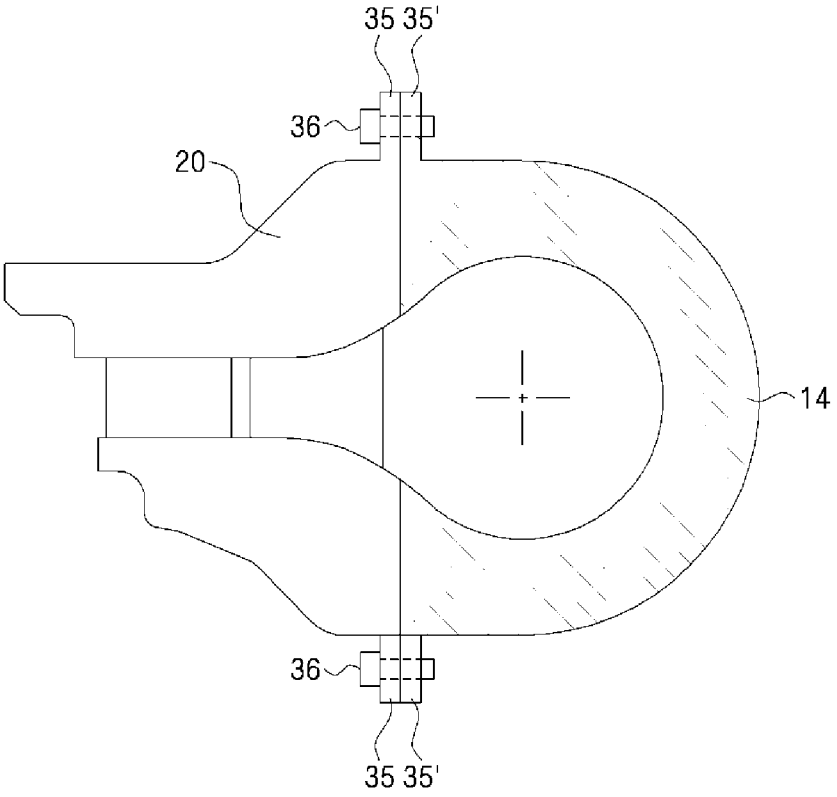
FIG. 10 shows flange parts according to an embodiment of the present disclosure.

Meanwhile, FIG. 10 shows a flange coupling method of the divisions 20 and the torus part 14.

More specifically, flange parts 35, 35' are respectively provided to the rear surface edges of the divisions 20 and the front surface edge of the torus part 14, and the divisions 20 are coupled to the torus part 14 by the coupling of the flanges 35, 35'. The flange coupling as mentioned above has an advantage that it is possible to carry out the coupling in a relatively simple structure, compared with the method of using the protrusion coupling parts 31, 32 and the recesses 31', 32' as mentioned hereinabove.

An additional sealing member may also be provided between the flanges so as to reinforce the sealing.

Meanwhile, since the above-mentioned coupling of the divisions 20 may be weak in terms of expansion, compared with the integral bridge ring 16 or the steam path ring 12, a restraining ring may be further provided so as to surround the edges of the divisions 20.

Figure 11:
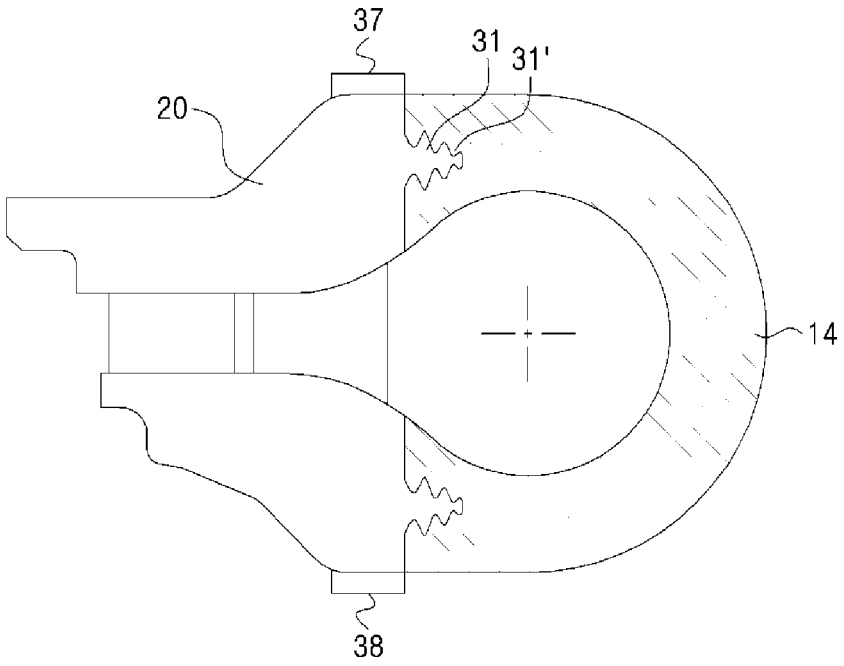
FIG. 11 shows restraining rings according to an embodiment of the present disclosure.

Such a restraining ring may be divided into an outer restraining ring 37 for surrounding the annular outer surface and an inner restraining ring 38 for surrounding the annular inner surface, as shown in FIG. 11, thereby respectively suppressing the expansion of the outer surface and the inner surface.

Hereinabove, even though all the constituent elements which form the embodiments of the present disclosure are explained to be coupled as a single body or operating as a single body in combination, the present disclosure is not necessarily limited to these embodiments. That is, within the purpose of the present disclosure, one or more of all the constituent elements can be selectively coupled to operate. In addition, it should be understood that the terms of "include", "form" or "have" used hereinabove mean that corresponding constituent elements can be inherent, unless otherwise defined, and thus shall be construed as that any other constituent elements are not excluded but may be further included. All the terms including all technical and scientific terms have, unless otherwise defined, the same meaning as commonly understood by a person skilled in the art, to which the present invention belongs.

It will be apparent to those skilled in the art that various changes and modifications may be made without departing from the spirit and scope of the following claims.

Moreover, the above advantages and features are provided in described embodiments, but shall not limit the application of the claims to processes and structures accomplishing any or all of the above advantages.

What is claimed is:

1. A nozzle box assembly comprising:

a torus part that is coupled to at least one steam inlet to provide an annular steam path to a stage of a steam turbine and that includes an open portion communicating with a downstream side of the annular steam path, the torus part having a planar surface communicating with the open portion; and a plurality of ring divisions respectively coupled to the planar surface of the torus part, each of the ring divisions comprising a bridge ring having a coupling surface for coupling with the planar surface of the torus part and including one or more bridges disposed toward the torus part, the bridge ring further including an inner portion and an outer portion respectively connected to opposite ends of the one or more bridges, the inner and outer portions of the bridge ring having respective coupling surfaces that face corresponding inner and outer portions of the planar surface of the torus part;

a steam path ring forming a steam path that communicates with the annular steam path via the bridge ring and including one or more vanes disposed downstream from the one or more bridges; and protrusion coupling parts formed on the respective coupling surfaces of the bridge ring and formed in the planar surface of the torus part, respectively, the protrusion coupling parts including inner protrusion coupling parts and outer protrusion coupling parts, wherein the inner protrusion coupling parts include an inner protrusion formed on the coupling surface of the inner portion of the bridge ring and an inner recess that corresponds to the inner protrusion and is formed in the inner portion of the planar surface of the torus part to receive the inner protrusion, respectively, and wherein the outer protrusion coupling parts include an outer protrusion formed on the coupling surface of the outer portion of the bridge ring and an outer recess that corresponds to the outer protrusion and is formed in the outer portion of the planar surface of the torus part to receive the outer protrusion, respectively.

2. The nozzle box assembly according to claim 1, wherein the plurality of ring divisions are arranged along a circumferential direction of the nozzle box assembly and include neighboring ring divisions that are coupled together in the circumferential direction of the nozzle box assembly, and wherein the circumferentially coupled ring divisions completely cover the open portion of the torus part.

3. The nozzle box assembly according to claim 2, wherein the neighboring ring divisions of the plurality of ring divisions include:

a first ring division having on one lateral side a sealing protrusion extending from the coupling surface of the bridge ring to a downstream side of the steam path ring; and a second ring division having on one lateral side a recess corresponding to the sealing protrusion and extending from the coupling surface of the bridge ring to the downstream side of the steam path ring, wherein the sealing protrusion engages with the recess so as to seal the one lateral side of the first ring division and the one lateral side of the second ring division.

4. The nozzle box assembly according to claim 1, further comprising:

an inner annular sealing plate inserted into inner annular sealing grooves formed in each of the coupling surface of the inner portion of the bridge ring and the inner portion of the planar surface of the torus part; and an outer annular sealing plate inserted into outer annular sealing grooves formed in each of the coupling surface of the outer portion of the bridge ring and the outer portion of the planar surface of the torus part.

5. The nozzle box assembly according to claim 4, further comprising:

an inner elastic seal disposed between a bottom surface of the inner annular sealing plate and a bottom surface of the inner annular sealing grooves; and an outer elastic seal disposed between a bottom surface of the outer annular sealing plate and a bottom surface of the outer annular sealing grooves.

6. The nozzle box assembly according to claim 1, wherein the steam path ring includes an inner portion and an outer portion respectively connected to opposite ends of the one or more vanes, and the inner and outer portions of the steam path ring form the steam path by extending from the inner and outer portions of the bridge ring, respectively.

7. The nozzle box assembly according to claim 1, wherein the protrusion coupling parts include a dovetail arrangement such that a dovetail protrudes from each of the coupling surfaces of the inner and outer portions of the bridge ring and a dovetail-shaped recess is formed in each of the coupling surfaces of the inner and outer portions of the torus part.

8. The nozzle box assembly according to claim 1, wherein the protrusion coupling parts include a fir tree arrangement such that a fir tree shape protrudes from each of the coupling surfaces of the inner and outer portions of the bridge ring and a fir tree-shaped recess is formed in each of the coupling surfaces of the inner and outer portions of the torus part.

9. The nozzle box assembly according to claim 1, wherein the protrusion coupling parts include:

inner flanges that protrude inwardly from the inner portion of the bridge ring and from the inner portion of the torus part, the inner flanges having opposing inner mounting surfaces that are disposed beyond exterior surfaces of the bridge ring and the torus part, respectively, and are flush with the coupling surface of the inner portion of the bridge ring and the planar surface of the inner portion of the torus part, respectively; and outer flanges that protrude outwardly from the outer portion of the bridge ring and from the outer portion of the torus part, the outer flanges having opposing outer mounting surfaces that are disposed beyond the exterior surfaces of the bridge ring and the torus part, respectively, and are flush with the coupling surface of the outer portion of the bridge ring and the planar surface of the outer portion of the torus part, respectively.

10. The nozzle box assembly according to claim 1, further comprising a restraining ring that surrounds edges of the plurality of ring divisions.

11. A nozzle box assembly comprising:

a torus part that is coupled to at least one steam inlet to provide an annular steam path to a stage of a steam turbine and that includes an open portion communicating with a downstream side of the annular steam path, the torus part having a planar surface communicating with the open portion; and a plurality of ring divisions respectively coupled to the planar surface of the torus part, each of the ring divisions comprising a first end coupled to the planar surface of the torus part and a second end extending from the first end, the first and second ends forming a steam path communicating with the annular steam path, wherein the plurality of ring divisions are arranged along a circumferential direction of the nozzle box assembly and include neighboring ring divisions that are coupled together in the circumferential direction of the nozzle box assembly, and the ring divisions completely cover the open portion of the torus part, wherein the neighboring ring divisions of the plurality of ring divisions include a first ring division having on one lateral side a sealing protrusion extending from a coupling surface of the first end to a downstream side of the second end, the coupling surface of the first end abutting the planar surface of the torus part; and a second ring division having on one lateral side a recess corresponding to the sealing protrusion and extending from the coupling surface of the first end to the downstream side of the second end, and the sealing protrusion engages with the recess so as to seal the one lateral side of the first ring division and the one lateral side of the second ring division.

12. The nozzle box assembly according to claim 11, further comprising protrusion coupling parts formed on the coupling surface of the first end of each of the ring divisions and formed in the planar surface of the torus part, respectively.

13. The nozzle box assembly according to claim 11, wherein the first end of each of the ring divisions includes an inner portion and an outer portion respectively connected to opposite ends of at least one bridge, and the inner and outer portions each have a surface forming part of the coupling surface of the first end and face corresponding inner and outer portions of the planar surface of the torus part.

14. The nozzle box assembly according to claim 13, wherein the second end of each of the ring divisions includes an inner portion and an outer portion respectively connected to opposite ends of at least one vane, and the inner and outer portions of the second end form the steam path by extending from the inner and outer portions of the first end, respectively.

15. The nozzle box assembly according to claim 13, further comprising protrusion coupling parts formed on the respective surfaces forming part of the coupling surface of the inner and outer portions of the first end and formed in the planar surface of the torus part, respectively, wherein the protrusion coupling parts include inner protrusion coupling parts and outer protrusion coupling parts, and wherein the inner protrusion coupling parts are formed on the coupling surface of the inner portion of the first end and are formed in the inner portion of the planar surface of the torus part, respectively, and the outer protrusion coupling parts are formed on the coupling surface of the outer portion of the first end and are formed in the outer portion of the planar surface of the torus part, respectively.

16. The nozzle box assembly according to claim 11, wherein each of the ring divisions further comprises:

at least one bridge supporting inner and outer portions of the first end of the ring division; and at least one vane supporting inner and outer portions of the second end of the ring division.

* * * * *